US006206565B1

(12) United States Patent
Kendall et al.

(10) Patent No.: US 6,206,565 B1
(45) Date of Patent: Mar. 27, 2001

(54) CONTINUOUS CONDITIONING OF DIELECTRIC FLUID IN AN X-RAY TUBE

(75) Inventors: Charles B. Kendall, Brookfield; Brian J. Graves; Hinhsomchay Phouybanhdyt, both of Waukesha, all of WI (US)

(73) Assignee: General Electric Company, New York, NY (US)

( * ) Notice: Subject to any disclaimer, the term of this patent is extended or adjusted under 35 U.S.C. 154(b) by 0 days.

(21) Appl. No.: 09/136,172

(22) Filed: Aug. 19, 1998

(51) Int. Cl.[7] ..... H05G 1/04
(52) U.S. Cl. ..... 378/202
(58) Field of Search ..... 378/199, 200, 378/201, 202

(56) References Cited

U.S. PATENT DOCUMENTS 4,265,720 * 5/1981 Winstel ..... 204/129
4,384,360 * 5/1983 Kitadate ..... 378/202
5,440,608 * 8/1995 Peralta ..... 378/199
5,596,622 * 1/1997 Peralta ..... 378/199
5,732,123 * 3/1998 Peralta ..... 378/199
6,123,456 * 9/2000 Lyons ..... 378/200

* cited by examiner

*Primary Examiner*—Teresa M. Arroyo
*Assistant Examiner*—Gioacchino Inzirillo
(74) *Attorney, Agent, or Firm*—Barbara Joan Haushalter; Christian G. Cabou

(57) ABSTRACT

In a radiographic apparatus having an x-ray tube, a method is provided for continuously conditioning the dielectric fluid in the x-ray tube during operation, thereby extending the service life of the x-ray tube. This is achieved by mounting a filter inside a filter housing, and mounting a replaceable gas reduction cartridge around the filter. The replaceable gas cartridge is filled with a material having a high affinity for the dielectric fluid. When the dielectric fluid enters at the filter outside diameter, the fluid moves radially inward so that the dielectric fluid flows over the high affinity material surfaces. The dielectric fluid then alloys with the high affinity material, thereby continuously conditioning the fluid.

12 Claims, 1 Drawing Sheet

CONTINUOUS CONDITIONING OF DIELECTRIC FLUID IN AN X-RAY TUBE

TECHNICAL FIELD

The present invention relates to x-ray tubes and, more particularly, to x-ray tubes that use a dielectric oil to provide high voltage isolation.

BACKGROUND ART

The x-ray tube has become essential in medical diagnostic imaging, medical therapy, and various medical testing and material analysis industries. One type of x-ray tube is a computerized tomography (CT) x-ray tube which is used in CT scanners. A typical CT scanner includes a stationary patient receiving region with a gantry mounted for rotation around the patient receiving region. An x-ray tube assembly which produces a radiation beam through an x-ray port across the patient receiving region is mounted to the gantry for purposes of rotation. A coolant fluid is circulated between the x-ray tube assembly and a cooling system (including a heat exchanger and pump) which is also mounted on the gantry. The coolant fluid flows through the x-ray tube assembly to remove heat created during x-ray generation. Finally, an arc or ring of radiation detectors surround the patient receiving region.

During operation, typically, the x-ray tube assembly generates a planar beam of radiation which is then rotated around the body. Various detectors, located around the patient, detect the intensity of the beam. The detectors are connected to a computer which, based on intensity readings, generates an image of a slice of the body. The patient is then moved longitudinally through the gantry with the x-ray tube assembly generating slices so that the computer can generate a three-dimensional image of the body.

In the course of generating slices, much heat is generated by the x-ray tube assembly and this heat must be removed if the service life of the x-ray tube is not to be unduly reduced. As described above, it is known to cool x-ray tubes by circulating a fluid, typically oil, within the tube and externally through a cooling system to remove as much heat as possible. In addition to being used as vehicle for cooling, the fluid is also used for its dielectric properties, in order to insulate the anode connection from ground (and/or the cathode connection), or, depending on the tube assembly, the dielectric oil used in x-ray tubes provides electrical insulation between the high voltage surfaces of the insert and the tube housing which is at ground potential. High voltage arcing can occur between these surfaces if the dielectric constant of the oil is reduced.

Coolant fluid, due to continuous heat and repeated arcing, will eventually break down. When the oil breaks down its dielectric properties as well as its ability to carry away heat (i.e. viscosity) are adversely affected. This results in less electrical insulation where needed, which leads to more arcing and, eventually, tube failure. Hence, proper electrical insulation (i.e., maintaining the proper dielectric property of the coolant fluid) is an important concern in x-ray tube use.

Several causes can reduce the dielectric constant of the oil, such as particulate contaminates, or dissolved hydrogen gas in the oil.

It would be desirable then to have a means for increasing the life of the dielectric oil used in x-ray tubes.

SUMMARY OF THE INVENTION

The present invention provides a device for continuous conditioning of dielectric fluid in an x-ray tube. The present invention achieves continuous conditioning of the dielectric oil by removing particles and dissolved hydrogen gas via a filtering device.

In accordance with one aspect of the present invention, a filter is fitted in an x-ray tube structure. The filter core is constructed of expanded metal, to allow the fluid to easily pass through the core. The core slides along the center of the filter providing interior support to prevent filter collapse. A replaceable gas reduction cartridge, filled with a material having a high affinity for hydrogen, is mounted around the filter.

Accordingly, it is an object of the present invention to provide improved electrical insulation between the high voltage surfaces of an x-ray tube insert and housing. It is a further object of the present invention to provide a device for continuous conditioning of the dielectric fluid in an x-ray tube during operation.

Other objects and advantages of the invention will be apparent from the following description, the accompanying drawings and the appended claims.

DETAILED DESCRIPTION OF THE PREFERRED EMBODIMENTS

As described above, the coolant fluid circulated in an x-ray tube structure serves at least two purposes: (1) providing electrical insulation between high voltage surfaces of the x-ray tube, for example, between the anode connection and ground (and/or the cathode connection) and (2) removing heat generated by the x-ray assembly. Inevitably, the oil breaks down, i.e., its dielectric properties, as well as its ability to carry away heat (viscosity), degrades. Adding to the overall degradation, an increased number of particulate matter and dissolved hydrogen gas accumulates in the coolant oil due to the oil break down from tube-related heat. Thus, to reduce and/or delay x-ray tube failures, and thereby extending the service life of an x-ray tube, the present invention employs a filtering device to remove particulate matter and dissolved hydrogen gas, thus continuously conditioning the dielectric oil.

Figure 1:
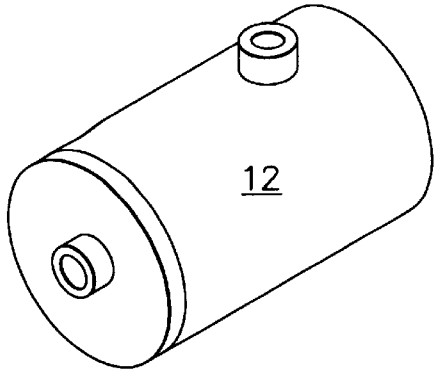
FIG. 1 illustrates the continuous conditioning apparatus in accordance with the present invention.

Referring now to FIG. 1, there is illustrated a representative embodiment of the apparatus 12 for continuous conditioning of the dielectric fluid in an x-ray tube.

Figure 2:
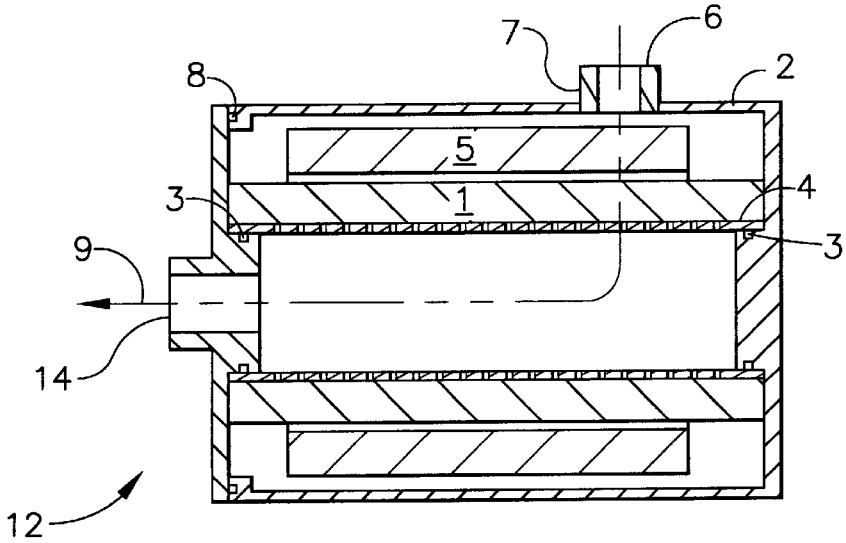
FIG. 2 is a partially cutaway section view illustrating the continuous conditioning apparatus of FIG. 1, in accordance with the present invention.

Referring now to FIG. 2, a filter 1 is mounted in a filter housing 2 and secured with any suitable means such as a pair of radial o-rings 3. A perforated filter core 4 prevents filter collapse under high pressure. A gas reduction cartridge 5 is positioned in the annular space between the filter and the housing.

Continuing with FIG. 2, an endcap 6 which includes an oil inlet port 7 encloses the filter and gas reduction cartridge in the housing and provides a leak tight seal through the use of an o-ring 8 or otherwise suitable means. Oil flows in the direction of the arrow 9 such that it enters the device through the inlet port entering the annular space between the filter and the housing. The oil then flows into the gas reduction cartridge 5.

Figure 3:
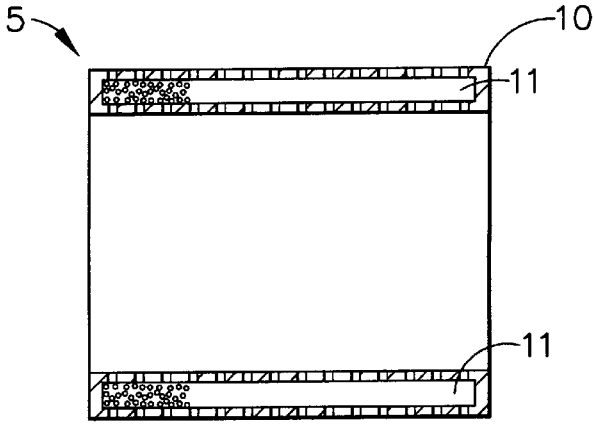
FIG. 3 is a partial cutaway section of the gas reduction cartridge element of the present invention.

Referring now to FIG. 3, the gas reduction cartridge 5 comprises a perforated annular housing 10 which contains a material 11 having a high affinity for hydrogen, particularly a material having a high affinity for hydrogen at temperatures less than 150 C. The material can be any suitable material, such as, but not limited to, palladium in the form of coated ceramic beads or corrugated foil.

As the hydrogen laden oil flows over the palladium surfaces, the dissolved hydrogen alloys with the palladium, or other material having high affinity for hydrogen. Consequently, it will be obvious to those skilled in the art that a preferred embodiment utilizes a maximum surface area for the high affinity material. Once the palladium is essentially saturated to the point where it cannot accept any more hydrogen, the gas reduction cartridge, in accordance with the present invention, is regenerated. The regeneration can be accomplished using any suitable method, such as by heating the cartridge to above 150 C in a vacuum furnace, to drive off the hydrogen. This provides the advantage of allowing for the reuse of the cartridge, thereby improving the overall economy of the apparatus 12, illustrated in FIG. 1.

Returning to FIG. 2, oil exiting the gas reduction cartridge flows through the filter in a radially inward direction. The oil then flows axial down the center of the filter and leaves the device through the outlet port 14.

The invention has been described in detail with particular reference to certain preferred embodiments thereof, but it will be understood that modifications and variations can be effected within the spirit and scope of the invention.

What is claimed is:

1. In a radiographic apparatus having an x-ray tube, a method for continuously conditioning dielectric fluid in the x-ray tube during operation, comprising the steps of:

mounting a filter inside a filter housing, the filter having an outside diameter;

entering the dielectric fluid to be filtered at the filter outside diameter; and moving said dielectric fluid radially inward as it is filtered.

2. A method as claimed in claim 1 further comprising the step of mounting a gas reduction cartridge around the filter.

3. A method as claimed in claim 2 further comprising the step of inserting into the cartridge a material having a high affinity for hydrogen gas in the dielectric fluid.

4. A method as claimed in claim 3 wherein the hydrogen gas in the dielectric fluid alloys with the high affinity material.

5. In a radiographic apparatus having an x-ray tube, a method for extending the service life of the x-ray tube, comprising the steps of:

mounting a filter inside a filter housing, the filter having an outside diameter;

mounting a replaceable gas reduction cartridge around said filter;

filling said replaceable gas cartridge with a material having a high affinity for hydrogen gas in the dielectric fluid;

entering the dielectric fluid at the filter outside diameter and moving said dielectric fluid radially inward so that the dielectric fluid flows over the high affinity material surfaces, whereby the hydrogen gas in the dielectric fluid alloys with the high affinity material to create an alloyed gas.

6. A method as claimed in claim 5 further comprising the step of regenerating the replaceable gas reduction cartridge to drive off the alloyed gas.

7. A method as claimed in claim 6 wherein the step of regenerating further comprises the step of heating the high affinity material in a vacuum furnace.

8. A method as claimed in claim 5 further comprising the step of providing a maximum surface area for the high affinity material.

9. In a radiographic apparatus having an x-ray tube, a device for continuously conditioning dielectric fluid in the x-ray tube during operation, comprising:

a filter mounted inside a filter housing;

a filter outside diameter associated with the filter for receiving dielectric fluid to be filtered; and a radial inward path for moving the dielectric fluid radially inward as it is filtered.

10. A device as claimed in claim 9 further comprising a gas reduction cartridge mounted around the filter.

11. A device as claimed in claim 10 further comprising a material having a high affinity for hydrogen gas in the dielectric fluid, the material being inserted into the cartridge.

12. A device as claimed in claim 11 wherein the hydrogen gas in the dielectric fluid alloys with the high affinity material.

* * * * *